US007914057B2

(12) United States Patent
Rohlf

(10) Patent No.: US 7,914,057 B2
(45) Date of Patent: Mar. 29, 2011

(54) VACUUM ANCHOR

(75) Inventor: Bradley A. Rohlf, Lakeville, MN (US)

(73) Assignee: D B Industries, Inc., Red Wing, MN (US)

( * ) Notice: Subject to any disclaimer, the term of this patent is extended or adjusted under 35 U.S.C. 154(b) by 1668 days.

(21) Appl. No.: 11/143,869

(22) Filed: Jun. 2, 2005

(65) Prior Publication Data

US 2006/0273600 A1 Dec. 7, 2006

(51) Int. Cl.
*A47J 45/00* (2006.01)

(52) U.S. Cl. ..... 294/64.1; 294/64.2; 182/3

(58) Field of Classification Search ..... 182/3; 294/64.1, 294/64.2
See application file for complete search history.

(56) References Cited

U.S. PATENT DOCUMENTS

| | | | | |
|---|---|---|---|---|
| 2,934,086 | A | 4/1960 | Blatt | |
| 3,568,959 | A * | 3/1971 | Blatt | 294/64.2 |
| 3,716,307 | A | 2/1973 | Hansen | |
| 4,073,602 | A * | 2/1978 | Cagle | 417/185 |
| 4,925,225 | A | 5/1990 | Dost | |
| 5,201,560 | A | 4/1993 | Golden | |
| 5,865,827 | A * | 2/1999 | Bullister | 606/1 |
| 6,024,392 | A * | 2/2000 | Blatt | 294/64.1 |
| 6,547,033 | B1 | 4/2003 | Cheval | |
| 6,607,054 | B1 | 8/2003 | Lindfield | |
| 6,745,868 | B2 | 6/2004 | Cheval | |
| 7,309,089 | B2 * | 12/2007 | Perlman et al. | 294/64.1 |
| 2003/0150672 | A1 | 8/2003 | Cheval | |
| 2004/0207219 | A1 * | 10/2004 | Schmierer et al. | 294/64.1 |
| 2005/0168001 | A1 * | 8/2005 | Perlman et al. | 294/64.1 |
| 2007/0187965 | A1 * | 8/2007 | Schaaf et al. | 294/64.1 |

FOREIGN PATENT DOCUMENTS

EP 0 477 834 A 4/1992

OTHER PUBLICATIONS

D B Industries, Inc., User Instruction Manual Vacuum Anchor Horizontal Lifeline System, 2003, pp. 1-12.
Latchways Fall Protection, Wingrip by Latchways, Website, date unknown, pp. 1-2.
Tritech Fall Protection Systems, Mobile Anchors—Aircraft/Hangar, Website, 2003, 2 pages.
Latchways Fall Protection, ManSafe® for Aircraft—Fall protection for aircraft maintenance, Wingrip® Overhead Systems, Website, date unknown, 8 pages.

* cited by examiner

*Primary Examiner* — J. Allen Shriver, II
*Assistant Examiner* — Alaeddin Mohseni
(74) *Attorney, Agent, or Firm* — IPLM Group, P.A.

(57) ABSTRACT

In one aspect of the invention, a vacuum anchor assembly for anchoring a fall protection system to a surface of an anchorage structure comprises an anchor member having an air input connector, a venturi, and a seal member incorporated into the anchor member. The air input connector is configured and arranged to receive air from a pressurized air source. The venturi is in fluid communication with the air input connector and is configured and arranged to receive air and create a vacuum therefrom. The seal member is in fluid communication with the venturi and is configured and arranged to receive the vacuum and resulting suction and create a seal between the anchor member and the surface of the anchorage structure sufficient to operatively connect the anchor member to the surface of the anchorage structure with the vacuum and resulting suction created within the anchor member.

18 Claims, 14 Drawing Sheets

FIG. 9
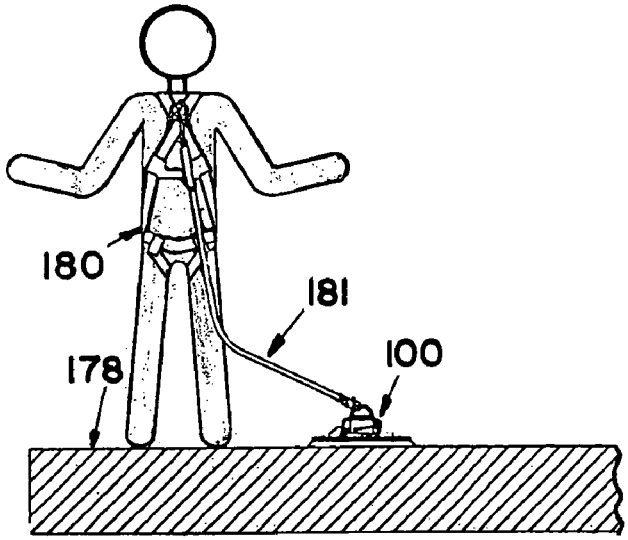
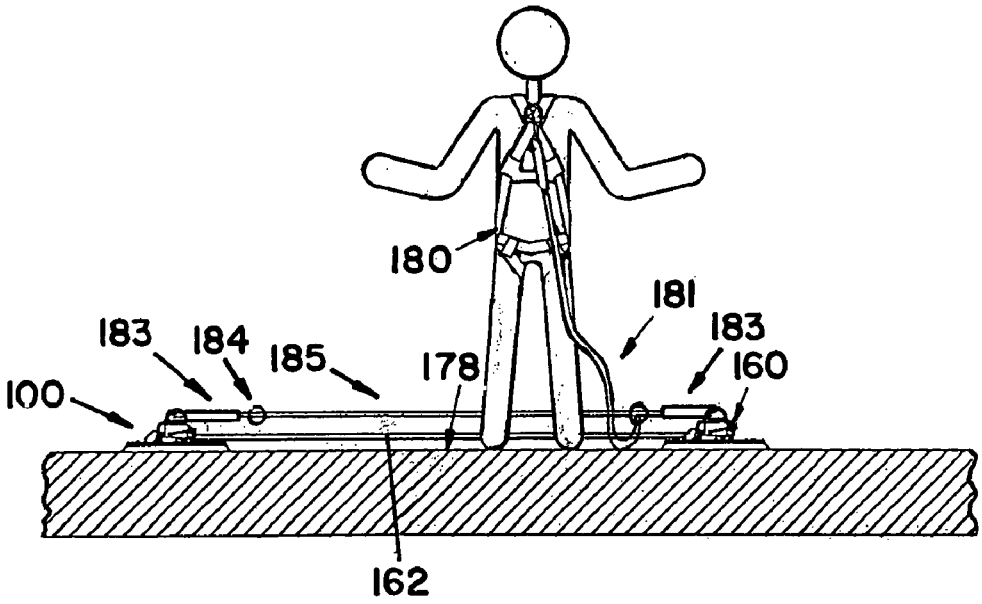
FIG. 10

FIG. 12
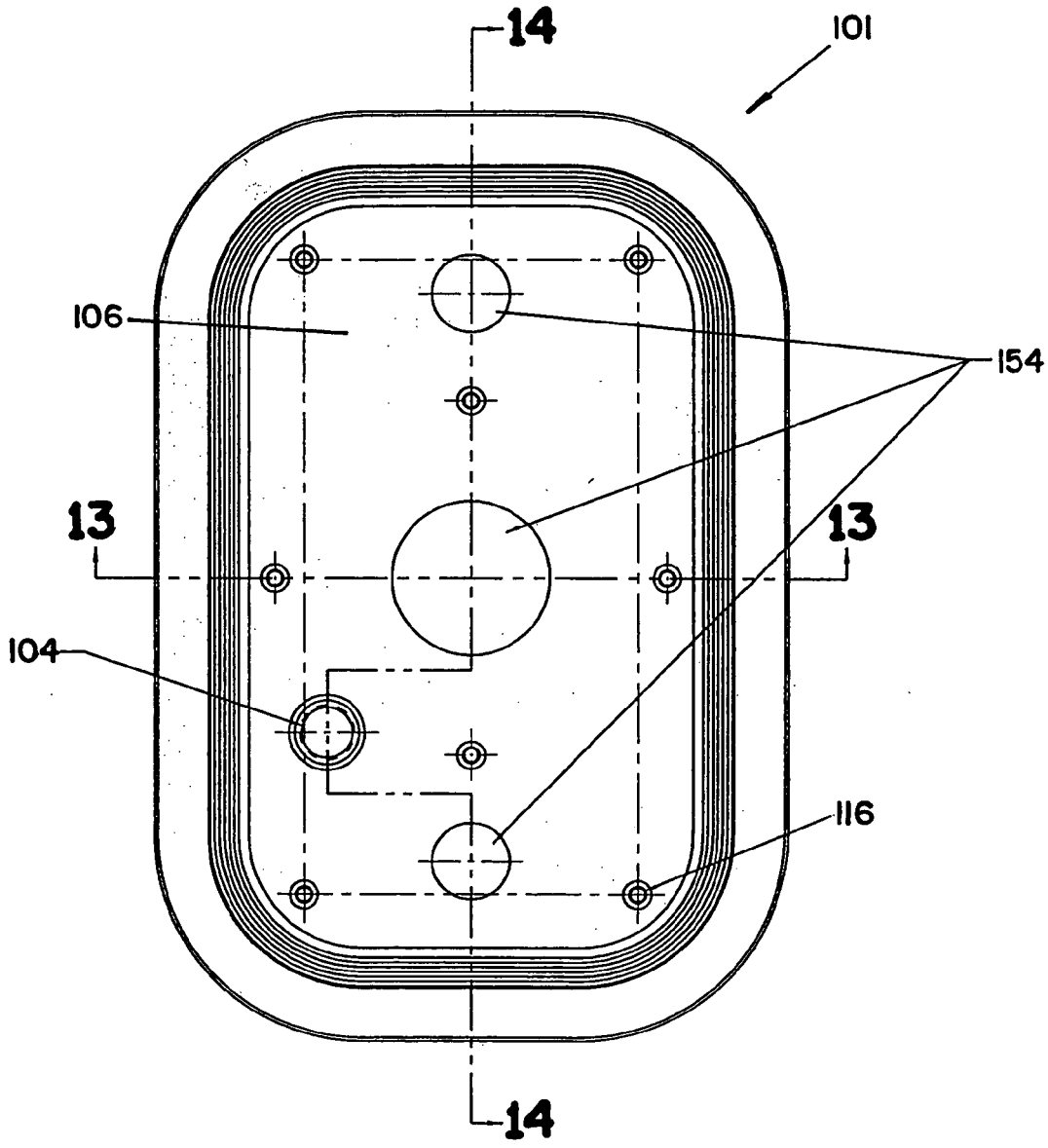
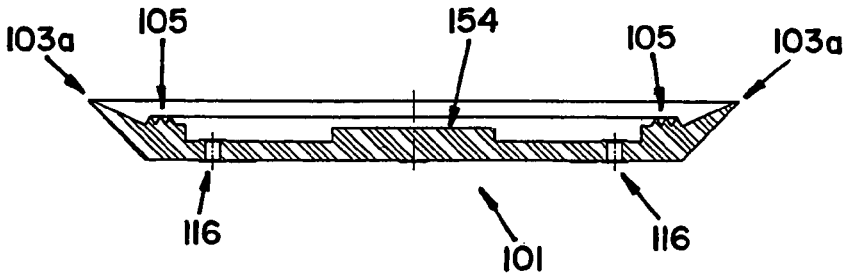
FIG. 13

VACUUM ANCHOR

FIELD OF THE INVENTION

The present invention relates to a vacuum anchor to be used as an anchorage connector for connection of a personal fall protection system for personnel working on aircraft or other anchorage structures.

BACKGROUND OF THE INVENTION

Safety devices enabling personnel to perform maintenance or inspection procedures on large anchorage structures such as aircraft, storage tanks, ships, submarines, railcars, trucks, roofs, and other anchorage structures are commonly used. One type of safety device commonly used on such anchorage structures is a vacuum anchor because the vacuum anchor does not damage the surface of the anchorage structure to which it is operatively connected by suction, provided the anchorage structure meets safety standards. A remote vacuum source is typically used to supply a vacuum to the vacuum anchor and to create the suction thereby operatively connecting the vacuum anchor to the anchorage structure. The vacuum anchor depends upon the vacuum being supplied by the remote vacuum source. Should the hose interconnecting the vacuum source and the vacuum anchor become obstructed such as by being pinched, clogged, or disconnected, the vacuum supplied to the vacuum anchor will be adversely affected thereby affecting the suction of the vacuum anchor. Should the vacuum become insufficient to secure the vacuum anchor, an alarm indicating the insufficient vacuum level will not provide sufficient notice to the user thereby potentially creating a risk of a fall hazard while the user connects to a safe anchorage point. The hose interconnecting the vacuum source and the vacuum anchor may create a trip hazard, and it may be time consuming to install. It is desired to create a vacuum anchor that is easy to install and provides a reliable anchorage point.

SUMMARY OF THE INVENTION

In one aspect of the invention, a vacuum anchor assembly for anchoring a fall protection system to a surface of an anchorage structure comprises an anchor member having an air input connector, a venturi, and a seal member incorporated into the anchor member. The air input connector is configured and arranged to receive air from a pressurized air source. The venturi is in fluid communication with the air input connector and is configured and arranged to receive air and create a vacuum therefrom. The seal member is in fluid communication with the venturi and is configured and arranged to receive the vacuum and resulting suction and create a seal between the anchor member and the surface of the anchorage structure sufficient to operatively connect the anchor member to the surface of the anchorage structure with the vacuum and resulting suction created within the anchor member.

In another aspect of the invention, a self-contained vacuum anchor assembly for anchoring a fall protection system to a surface of an anchorage structure comprises an anchor member having a housing, an air input connector, a venturi, and a seal member incorporated into the anchor member. The housing contains the venturi. The air input connector is configured and arranged to receive air from a pressurized air source. The venturi is in fluid communication with the air input connector and is configured and arranged to receive air and create a vacuum therefrom. The seal member is in fluid communication with the venturi and is configured and arranged to receive the vacuum and resulting suction and create a seal between the anchor member and the surface of the anchorage structure sufficient to operatively connect the anchor member to the surface of the anchorage structure with the vacuum and resulting suction created within the anchor member.

In another aspect of the invention, a method of securing a vacuum anchor assembly to a surface of an anchorage structure for anchoring a fall protection system to the surface comprises placing the vacuum anchor assembly on the surface of the anchorage structure, connecting the vacuum anchor assembly to a pressurized air source, creating a vacuum internally within the vacuum anchor assembly from the pressurized air source, and securing the vacuum anchor assembly to the surface of the anchorage structure with suction resulting from the vacuum.

BRIEF DESCRIPTION OF THE DRAWINGS

FIG. 9 shows an energy absorbing lanyard interconnecting a harness donned by a user and the vacuum anchor shown in FIG. 1;

FIG. 10 shows one end of a horizontal lifeline operatively connected to the vacuum anchor shown in FIG. 1 and the other end of the horizontal lifeline operatively connected to the auxiliary vacuum anchor shown in FIG. 8 and an energy absorbing lanyard interconnecting a harness donned by a user and the horizontal lifeline;

FIG. 12 is a bottom view of the anchor member shown in FIG. 11;

FIG. 13 is a cross section view taken along the lines 13-13 in FIG. 12;

DETAILED DESCRIPTION OF A PREFERRED EMBODIMENT

Figure 1:
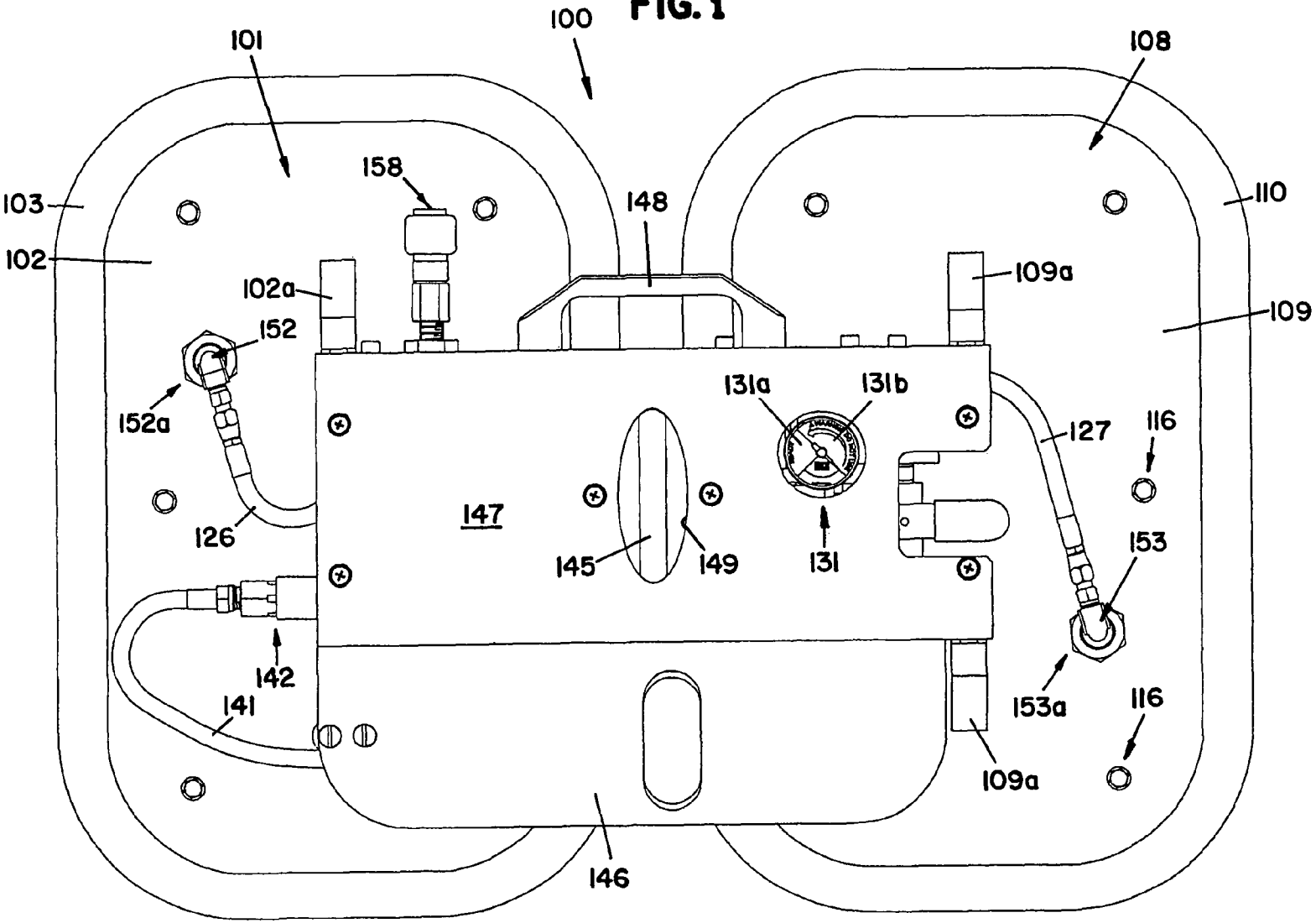
FIG. 1 is a top plan view of a vacuum anchor constructed according to the principles of the present invention.

A preferred embodiment vacuum anchor constructed according to the principles of the present invention is designated by the numerals 100 and 100' in the drawings. A preferred embodiment auxiliary vacuum anchor constructed according to the principles of the present invention is designated by the numeral 160 in the drawings.

Figure 11:
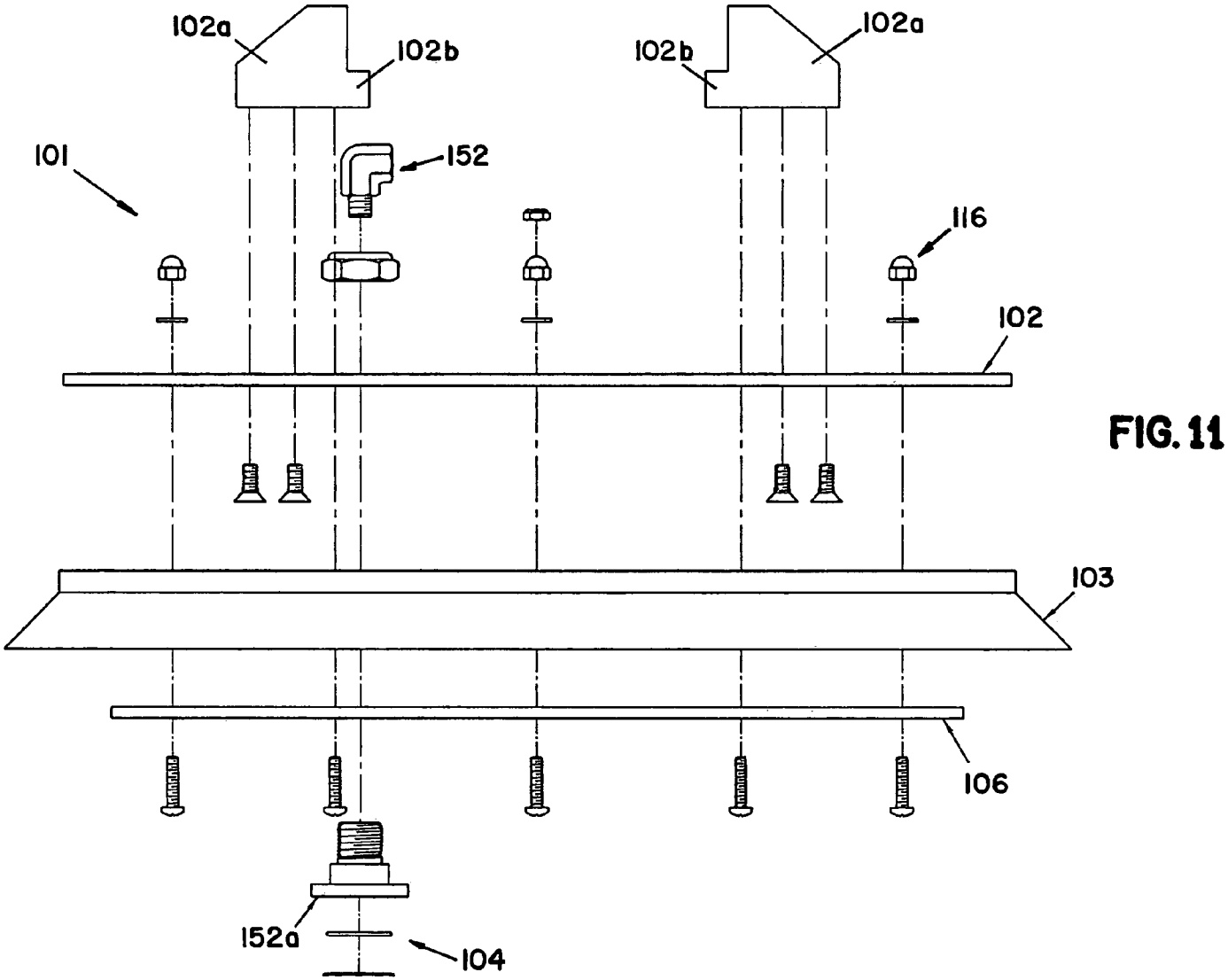
FIG. 11 is an exploded side view of an anchor member of the vacuum anchor shown in FIG. 1.

The vacuum anchor 100 includes a first anchor member 101 and a second anchor member 108. The first anchor member 101 preferably includes a first seal member 103 sandwiched between a first plate member 102 and a first bottom plate member 106 and operatively connected therebetween by fasteners 116 as shown in FIG. 11. The fasteners 116 extend through the first plate member 102, the first seal member 103, and the first bottom plate member 106 and are secured thereto. Preferably, the fasteners 116 are bolts and nuts but other suitable fasteners could be used. The first plate member 102 and the first bottom plate member 106 are each preferably rectangular plates made of aluminum, although it is recognized that other suitable materials such as steel and carbon fiber composite material could also be used. The first seal member 103 is preferably a flexible concave member made of ethylene propylene because of its compatibility with SKYDROL™, a hydraulic fluid commonly used in aircrafts, as ethylene propylene has an acceptable resistance to deterioration when contacted with SKYDROL™. However, it is recognized that other suitable materials such as polychloroprene, nitrile, silicone, and natural rubber could also be used for the first seal member 103 depending upon the application and the environment of use.

Figure 5:
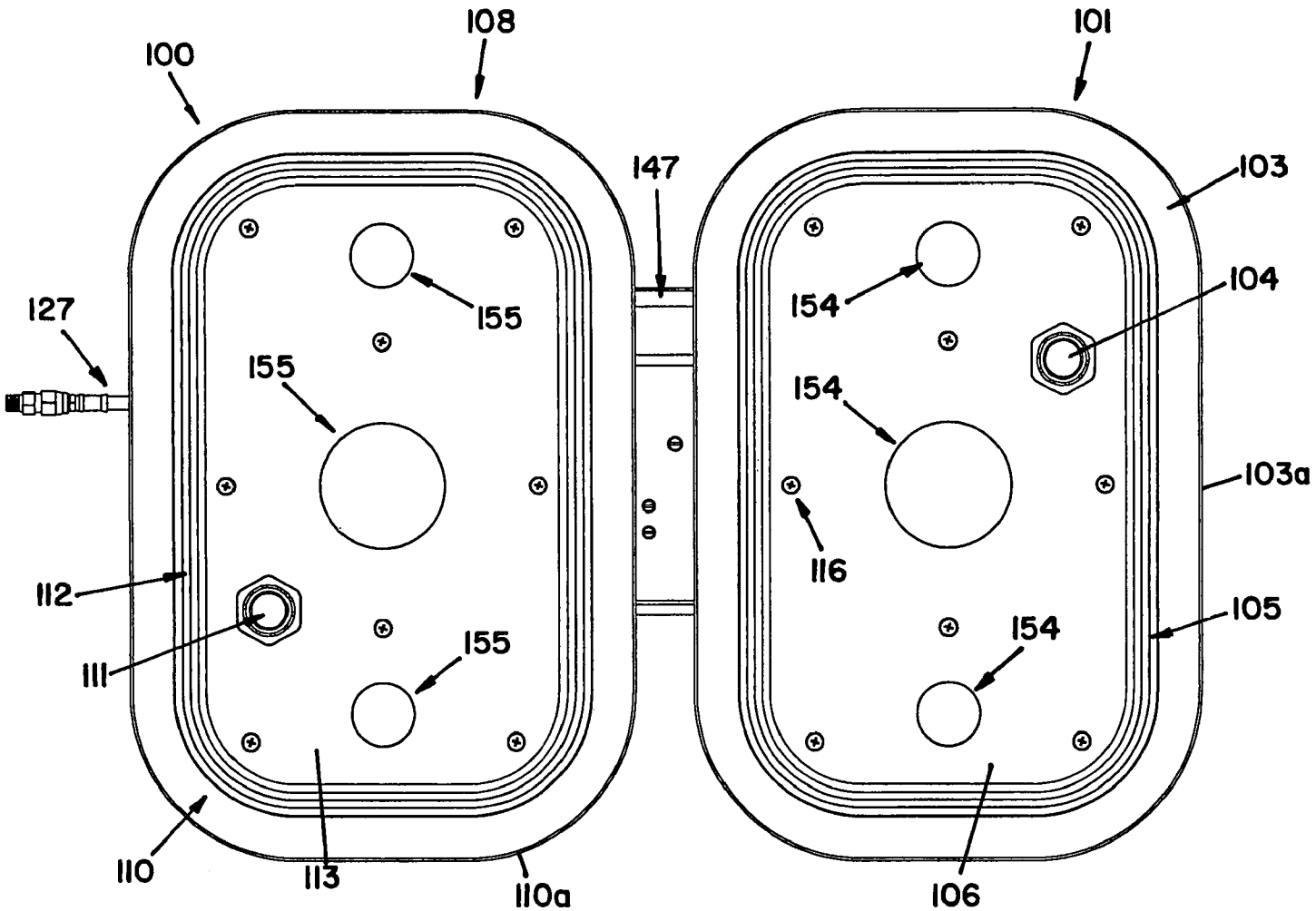
FIG. 5 is bottom plan view of the vacuum anchor shown in FIG. 4.

The first seal member 103 includes sealing lips 103*a* and 105 proximate a bottom surface of the first seal member 103. The bottom surface of the first seal member 103 is shown in FIG. 5. The sealing lip 103*a* is proximate the bottom perimeter of the first seal member 103 and forms the main seal between the first anchor member 101 and the surface of the anchorage structure to which it is attached. The sealing lips 105 are preferably concentric rings proximate the sealing lip 103*a* and provide backup seals in the event the main seal of sealing lip 103*a* is breached. Preferably, there are three rings of sealing lips 105 on the first seal member 103, and the distance between the sealing lips 105 is preferably approximately 0.188 inch, but the distance could vary depending upon the size of the first seal member 103.

Figure 14:
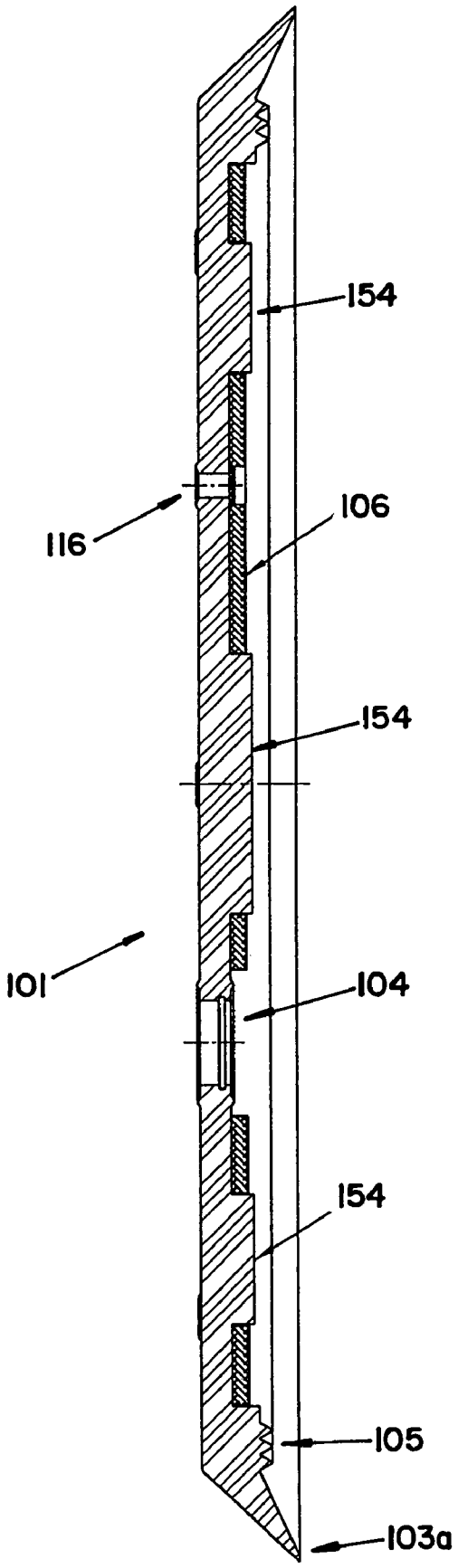
FIG. 14 is a cross section view taken along the lines 14-14 in FIG. 12.

As shown in FIG. 1, the first plate member 102 includes a connector 152 and a fitting 152*a*. The fitting 152*a* connects the connector 152 to the first plate member 102, and the connector 152 is configured and arranged to connect to a first vacuum inlet hose 126. As shown in FIGS. 12-14, the first bottom plate member 106 includes apertures through which portions of the first seal member 103 extend as scuff pads 154 to cushion and protect the surface of the anchorage structure so that it does not get scratched or damaged by the first bottom plate 106. Preferably, there are three scuff pads 154 aligned along the longitudinal axis of the first bottom plate member 106, and there is a relatively larger scuff pad 154 located proximate the middle of the first bottom plate member 106 and a relatively smaller scuff pad 154 located proximate each end of the first bottom plate member 106. The first bottom plate member 106 also includes an aperture to which a first vacuum inlet filter screen 104 is connected.

The second anchor member 108 is preferably substantially identical to the first anchor member 101. The second anchor member 108 preferably includes a second seal member 110 sandwiched between a second plate member 109 and a second bottom plate member 113 and operatively connected therebetween by fasteners 116. The fasteners 116 extend through the second plate member 109, the second seal member 110, and the second bottom plate member 113 and are secured thereto. The second plate member 109, the second bottom plate member 113, and the second seal member 110 are preferably made of the same materials as the first plate member 102, the first bottom plate member 106, and the first seal member 103, respectively.

The second seal member 110 includes sealing lips 110*a* and 112 proximate a bottom surface of the second seal member 110. The bottom surface of the second seal member 110 is shown in FIG. 5. The sealing lip 110*a* is proximate the bottom perimeter of the second seal member 110 and forms the main seal between the second anchor member 108 and the surface of the anchorage structure to which it is attached. The sealing lips 112 are preferably concentric rings proximate the sealing lip 110*a* and provide backup seals in the event the main seal of sealing lip 110*a* is breached. Preferably, there are three rings of sealing lips 112 on the second seal member 110, and the distance between the sealing lips 112 is preferably approximately 0.188 inch, but the distance could vary depending upon the size of the second seal member 110.

Similarly, as shown in FIG. 1, the second plate member 109 includes a connector 153 and a fitting 153*a*. The fitting 153*a* connects the connector 153 to the second plate member 109, and the connector 153 is configured and arranged to connect to a second vacuum inlet hose 127. Although not shown, the second bottom plate member 113 includes corresponding components as shown in FIGS. 12-14 for the first bottom plate member 106. The second bottom plate member 113 includes apertures through which portions of the second seal member 110 extend as scuff pads 155 to cushion and protect the surface of the anchorage structure so that it does not get scratched or damaged by the second bottom plate 113. Preferably, there are three scuff pads 155 aligned along the longitudinal axis of the second bottom plate member 113, and there is a relatively larger scuff pad 155 located proximate the middle of the second bottom plate member 113 and a relatively smaller scuff pad 155 located proximate each end of the second bottom plate member 113. The second bottom plate member 113 also includes an aperture to which a second vacuum inlet filter screen 111 is connected.

A support 102*a*, as shown in FIG. 11, is preferably a wedge-shaped member with a lip 102*b* extending outward from the bottom of the taller end. Preferably, two supports 102*a* are operatively connected to the first plate member 102, preferably with screws, aligned along the longitudinal axis proximate the ends of the first plate member 102. The supports 102*a* are positioned so that the lips 102*b* are pointed toward one another toward the middle of the first plate member 102.

Similarly, a support 109*a* is preferably a wedge-shaped member with a lip 109*b* extending outward from the bottom of the taller end. Preferably, two supports 109*a* are operatively connected to the second plate member 109, preferably with screws, aligned along the longitudinal axis proximate the ends of the second plate member 109. The supports 109*a* are positioned so that the lips 109*b* are pointed toward one another toward the middle of the second plate member 109.

Figure 15:
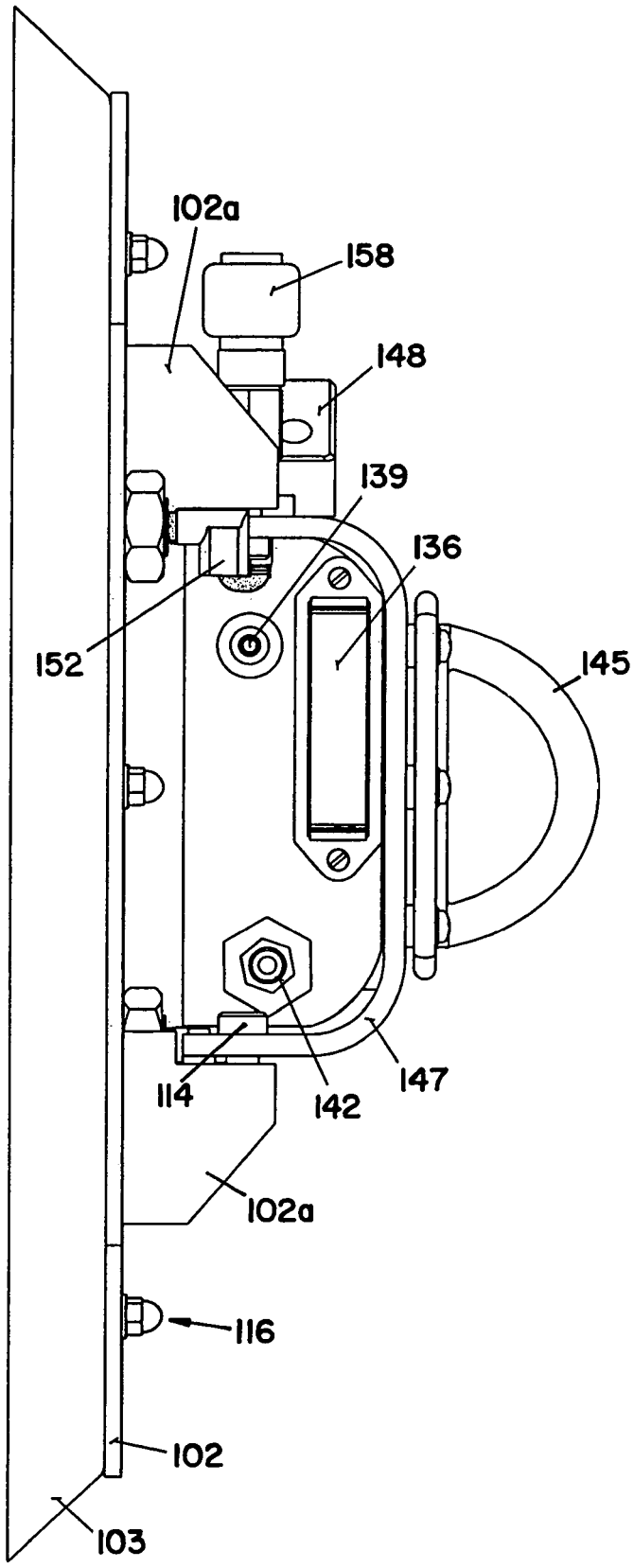
FIG. 15 is a side view of the anchor member shown in FIG. 1.

As shown in FIG. 15, the lips 102*b* and 109*b* are configured and arranged to support each end of a housing plate 147, which is preferably an upside down U-shaped plate member, and bolts 114 secure the ends of the housing plate 147 to the lips 102*b* and 109*b*. In other words, the first plate member 102 and the second plate member 109 are interconnected by the housing plate 147, which is also preferably made of aluminum, by bolts or other suitable fasteners. Preferably, the bolts 114 do not tightly secure the ends of the housing plate 147 against the supports 102*a* and 109*a* so that there is a small gap allowing the anchor members 101 and 108 to pivot approximately 15 degrees, approximately 7.5 degrees in each direction, about the shafts of the bolts 114 to allow the vacuum anchor 100 to conform to surfaces that are not planar such as curved surfaces. The housing plate 147 forms a cavity 149 between the ends of the housing plate 147 and the plate members 102 and 109. A connector 145 is operatively connected to the housing plate 147 proximate a center portion of the housing plate 147 and extends in an upward direction therefrom. Preferably, the connector 145 is made of an alloy steel. The connector 145 is configured and arranged for attachment to a snap hook, a carabiner, or other suitable connector of a lifeline such as a horizontal lifeline, a lanyard, a self-retracting lifeline, or other suitable lifeline.

Figure 2:
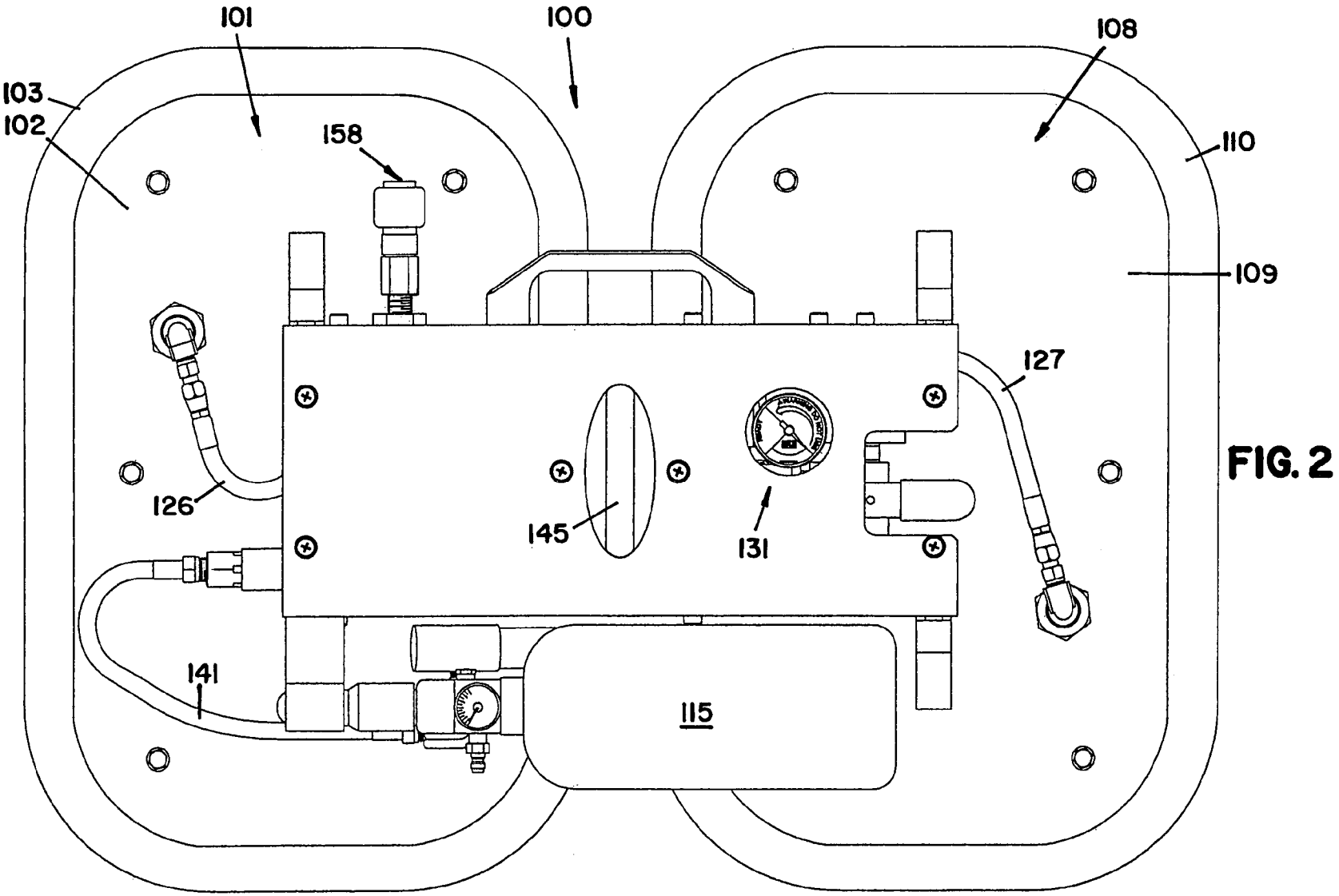
FIG. 2 is a top plan view of the vacuum anchor shown in FIG. 1 with a guard plate removed.

A guard plate 146 may be operatively connected to the housing plate 147 to protect an air cylinder bottle 115, if used. An example of a suitable air cylinder bottle is a 48 CC 3,000 psi bottle of compressed air, Part No. 10519, manufactured by Pursuit Marketing Inc. in Des Plaines, Ill. The length of time the air cylinder bottle 115 lasts depends largely upon the surface of the anchorage structure and upon how many times the vacuum anchor 100 is sealed and resealed onto an anchorage structure. FIG. 1 shows the vacuum anchor 100 with the guard plate 146, and FIG. 2 shows the vacuum anchor 100 without the guard plate 146. A handle 148 may be operatively connected to the housing plate 147 to assist in carrying and positioning the vacuum anchor 100.

Figure 4:
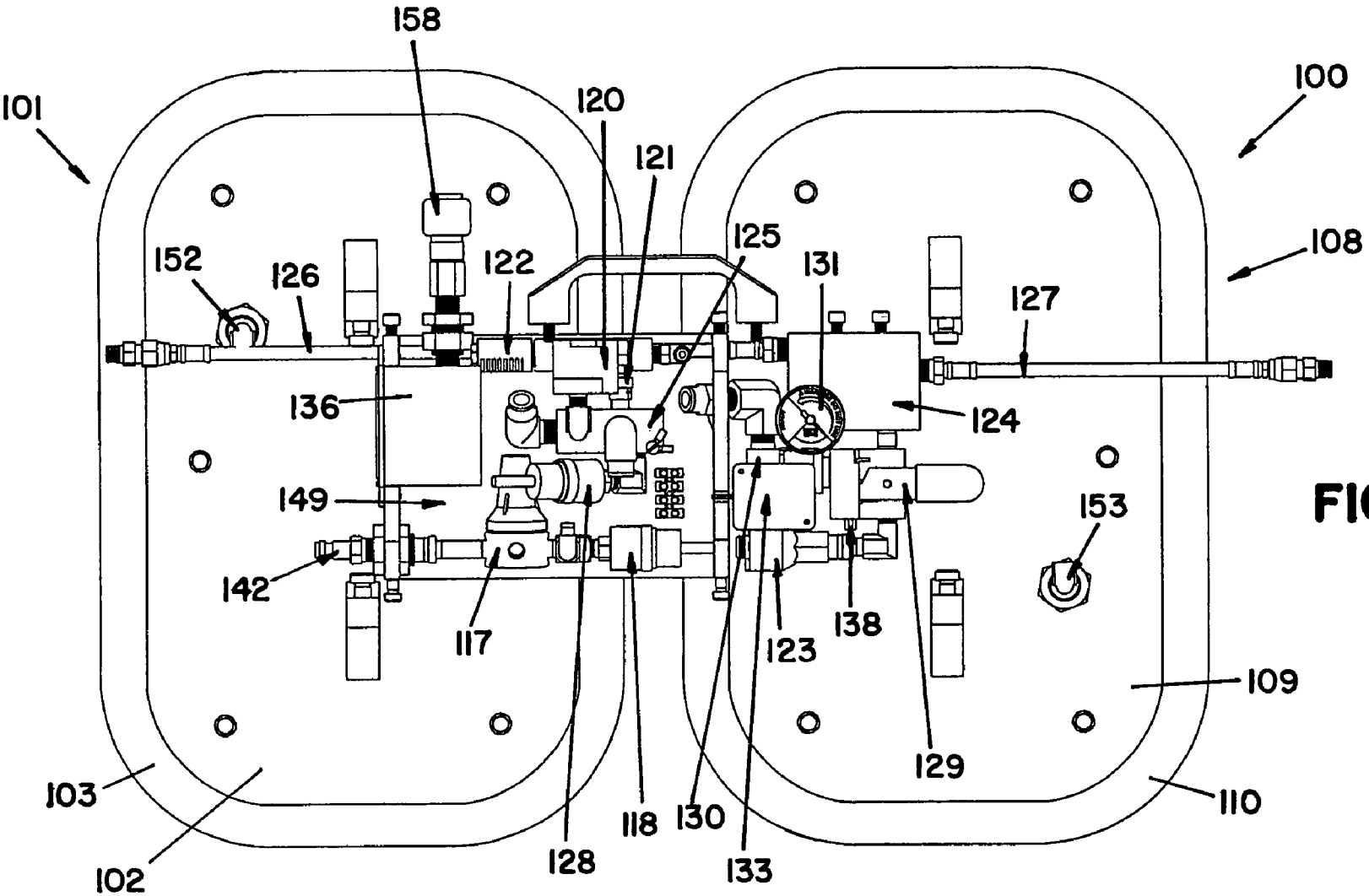
FIG. 4 is a top plan view of the vacuum anchor shown in FIG. 3 with a housing plate removed.

The cavity 149 is configured and arranged to house several components of the vacuum anchor 100 shown in FIG. 4. The components are incorporated into the vacuum anchor 100 because they are physically connected and contained within the vacuum anchor 100 and not located remotely. An air input connector 142, which is preferably a quick connector, extends outward from the cavity 149 proximate an adjacent side of the housing plate 147 to which the guard plate 146 is operatively connected. The air input connector 142 is configured and arranged for quick connection to an air hose 141 through which air flows from an air source and is preferably easily accessible. A pressure regulator 117 is in fluid communication with the air input connector 142 and is preferably adjustable but preset for the end user to approximately 85 to 100 psi to regulate the air pressure to a usable level. An example of a suitable pressure regulator is a ⅛ NPT pressure regulator set to 85 psi, Part No. R14 100 R85A manufactured by Norgren Inc. in Littleton, Colo. A pressure switch 118 is in fluid communication with the pressure regulator 117 and monitors the incoming air pressure to ensure it is high enough, preferably greater than 75 psi. An example of a suitable pressure switch is a ⅛ NPT pressure switch set to 75 psi, Part No. P110-55W3 manufactured by Wasco Inc. in Santa Maria, Calif. The pressure switch 118 is in an open position if the pressure level is greater than approximately 75 psi and is in a closed position if the pressure level is less than approximately 75 psi.

An air valve vacuum switch 120 is in fluid communication with a venturi 122. An example of a suitable air valve vacuum switch is a ⅛ NPT silicone air valve vacuum switch, Part No. VP-700-30-PT manufactured by Airtrol Components Inc. in New Berlin, Wis. An example of a suitable venturi is Part No. JS-100M manufactured by Vaccon Company Inc. in Medfield, Mass. The venturi 122 receives air and creates a vacuum within the vacuum anchor 100. A check valve 121 is in fluid communication with the venturi 122 and ensures that the vacuum flowing out of the venturi 122 and into a vacuum manifold 125 does not flow back into the venturi 122. The vacuum manifold 125 is in fluid communication with a vacuum switch 128, a filter 130, and a vacuum output connector 158. A check valve 123 ensures that the vacuum flowing through the filter 130 and into a vacuum control valve 129 does not flow back into the vacuum manifold 125.

The check valves 121 and 123 are preferably one-way valves. An example of a suitable check valve is ¼ NPT quick exhaust valve, Part No. SZE2 manufactured by Humphrey Products Company in Kalamazoo, Mich. The check valve 121 ensures that the vacuum created by the venturi 122 enters the vacuum manifold 125 but does not exit the vacuum manifold 125, and the check valve 123 ensures that the vacuum enters the vacuum control valve 129 but does not exit the vacuum control valve 129. Should the air supply to the vacuum anchor 100 become interrupted, the vacuum will not be lost through the vacuum manifold 125 and the vacuum control valve 129. This is a safety feature allowing time for connection to another anchorage point. Should the vacuum level become insufficient, a vacuum switch 128 activates an alarm. An example of a suitable vacuum switch is ⅛ NPT vacuum switch set to 20 inches Hg, Part No. V 110-31W3B-X/9863 manufactured by Wasco Inc. in Santa Maria, Calif. The vacuum switch 128 is in fluid communication with the vacuum manifold 125, and the vacuum switch 128 is in an open position if the vacuum level is greater than approximately 20 inches Hg and is in a closed position if the vacuum level is less than approximately 20 inches Hg. Preferably, the vacuum level is approximately 25 inches Hg. The vacuum switch 128 reads both anchor members 101 and 108 since the anchor members 101 and 108 are in fluid communication with the vacuum manifold 125.

The vacuum control valve 129 is in fluid communication with the vacuum manifold 125 and controls the vacuum level supplied to the anchor members 101 and 108. An example of a suitable vacuum control valve is Part No. 8-42VF2 manufactured by Swagelok Company in Solon, Ohio. The vacuum control valve 129 is preferably a main ball valve. When it is desired to disconnect the vacuum anchor 100, the vacuum control valve 129 is adjusted to decrease the vacuum thereby decreasing the resulting suction to allow the vacuum anchor 100 to be disconnected. The suction created by the vacuum could cause contaminants on the surface of the anchorage structure to enter the internal components of the vacuum anchor 100, and the filter 130 is used to prevent contaminants from entering the internal components of the vacuum anchor 100. An example of a suitable filter is Part No. B-4TF2-40 manufactured by Swagelok Company in Solon, Ohio.

Figure 6:
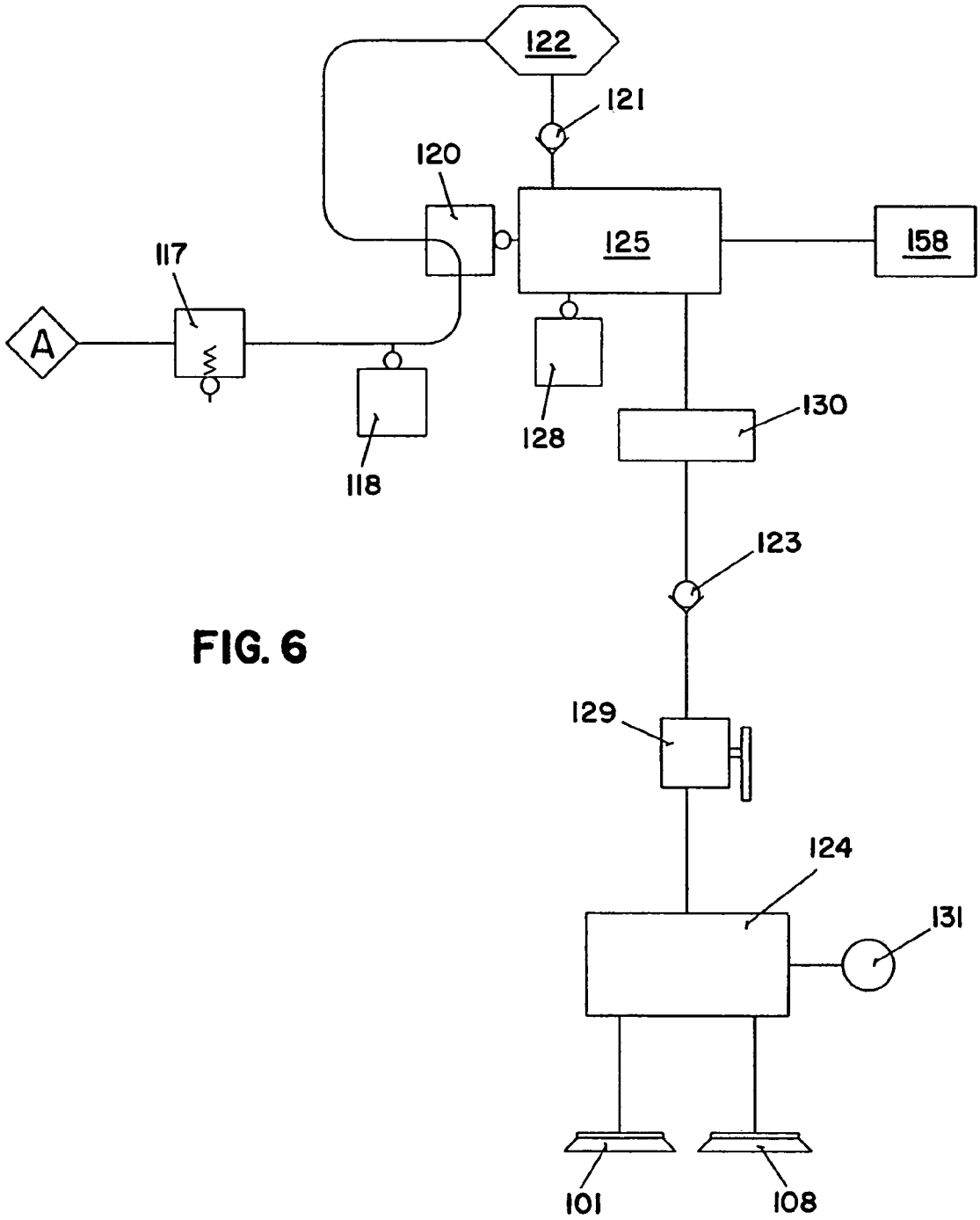
FIG. 6 is a schematic diagram of a pneumatic system of the vacuum anchor shown in FIG. 1.

A manifold 124 is in fluid communication with the vacuum control valve 129, which supplies the vacuum to the manifold 124. The manifold 124 is also in fluid communication with a vacuum gauge 131 and vacuum inlet hoses 126 and 127 interconnecting the manifold 124 and the anchor members 101 and 108, respectively. The vacuum gauge 131 is calibrated to visually indicate the level of vacuum and is divided into a "ready" position 131*a* and a "warning do not use" position 131*b*. An example of a suitable vacuum gauge is ⅛M-NPT CBM X 1½ inches Ashcroft® vacuum gauge, Part No. AC 15-1005-01B-30, manufactured by Dresser, Inc. in Addison, Tex. The vacuum gauge 131 measures the vacuum level proximate the manifold 124 to indicate if there is a leak in the device. Operatively connected to the manifold 124 are vacuum inlet hoses 126 and 127, which are configured and arranged to operatively connect to the connectors 152 and 153 of the first anchor member 101 and the second anchor member 108, respectively, which are in fluid communication with the manifold 124 as shown in FIG. 6.

Figure 7:
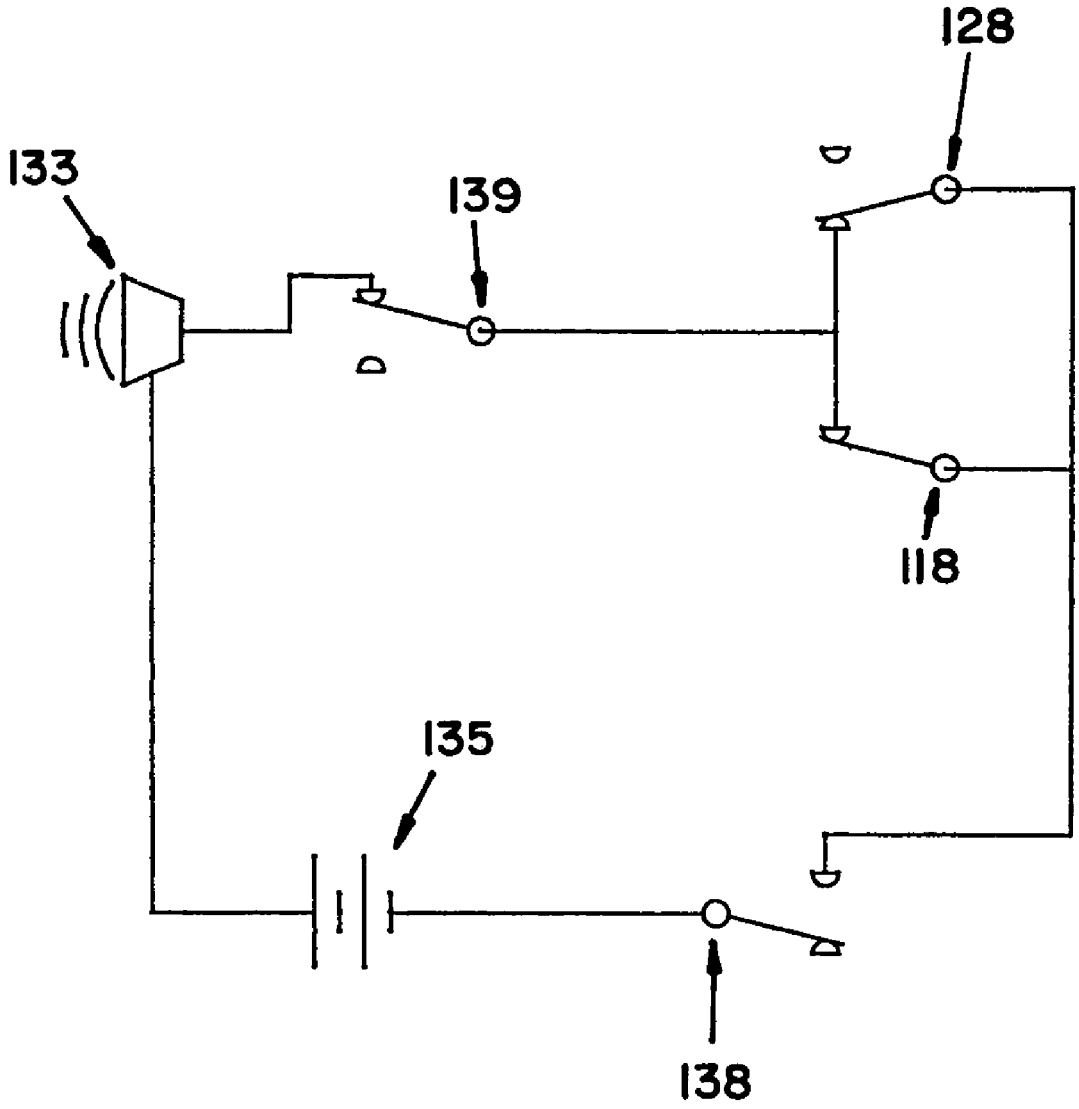
FIG. 7 is a schematic diagram of an electrical system of the vacuum anchor shown in FIG. 1.

An audio alarm 133, as shown in FIG. 7, will sound if the level of vacuum or the air pressure is insufficient to audibly indicate that the vacuum anchor 100 may not be suitable for use as an anchorage point. An example of a suitable audio alarm is a 5 to 15 Volt direct current audio alarm, Part No. PS-723, manufactured by Mallory Sonalert Products, Inc. in Indianapolis, Ind. Preferably a single pole, double throw (hereinafter "SPDT") momentary subminiature switch 138 is operatively connected to the vacuum control valve 129 and closes to arm the alarm 133 when the vacuum control valve 129 is opened. As shown in FIG. 7, the vacuum control valve 129 opens to arm the alarm by closing the SPDT momentary subminiature switch 138 and closes to disarm the alarm by opening the SPDT momentary subminiature switch 138. Other suitable types of switches such as a single throw switch could also be used. An example of a suitable SPDT momentary subminiature switch is Part No. DC3C-M3AA manufactured by Cherry Electrical Components in Pleasant Prairie, Wis. When the SPDT momentary subminiature switch 138 is open, the alarm 133 will not sound. When the alarm 133 is armed, a momentary push button 139, as shown in FIGS. 7 and 15, may be used as an override button and activated by pressing the button to disarm the alarm 133 when the vacuum anchor 100 is initially attached to the surface of the anchorage structure because the vacuum level is initially insufficient. An example of a suitable momentary push button is Part No. MSPF-101BC(0) manufactured by Tyco International (US) Inc. in Portsmouth, N.H.

A battery 135 contained in a battery housing 136 is used to power the audio alarm 133. Preferably, four AA lithium iron disulfide batteries such as Part No. L91BP-4 manufactured by Energizer Holdings, Inc. in St. Louis, Mo. are used. A four drawer AA battery holder such as Part No. BX0027 manufactured by Bulgin Components PLC in Essex, England is preferably used.

Figure 8:
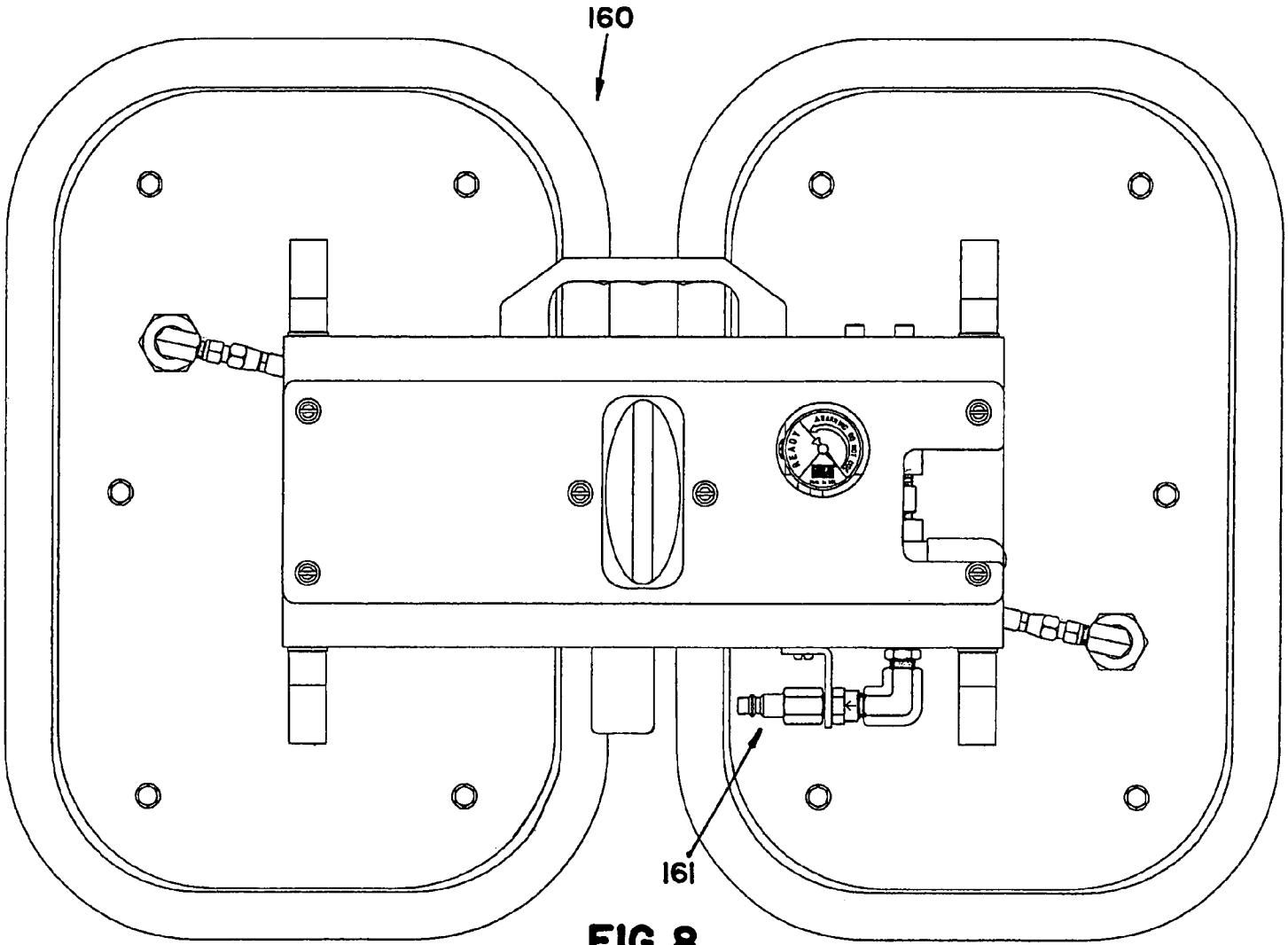
FIG. 8 is a top plan view of an auxiliary vacuum anchor constructed according to the principles of the present invention.

A vacuum output connector 158, which is preferably a quick connector, extends outward from the cavity 149 proximate a side of the housing plate 147 to which the handle 148 is operatively connected. The vacuum output connector 158 is configured and arranged for quick connection to a vacuum hose 162 through which vacuum flows from the vacuum anchor 100 and is preferably easily accessible. The vacuum hose 162 interconnects the vacuum anchor 100 to the auxiliary vacuum anchor 160, to which vacuum is regulated by and supplied by the vacuum anchor 100. The auxiliary vacuum anchor 160, shown in FIG. 8, includes a vacuum input connector 161, which is also preferably a quick connector, configured and arranged for quick connection to the vacuum hose 162 and is preferably easily accessible.

Figure 16:
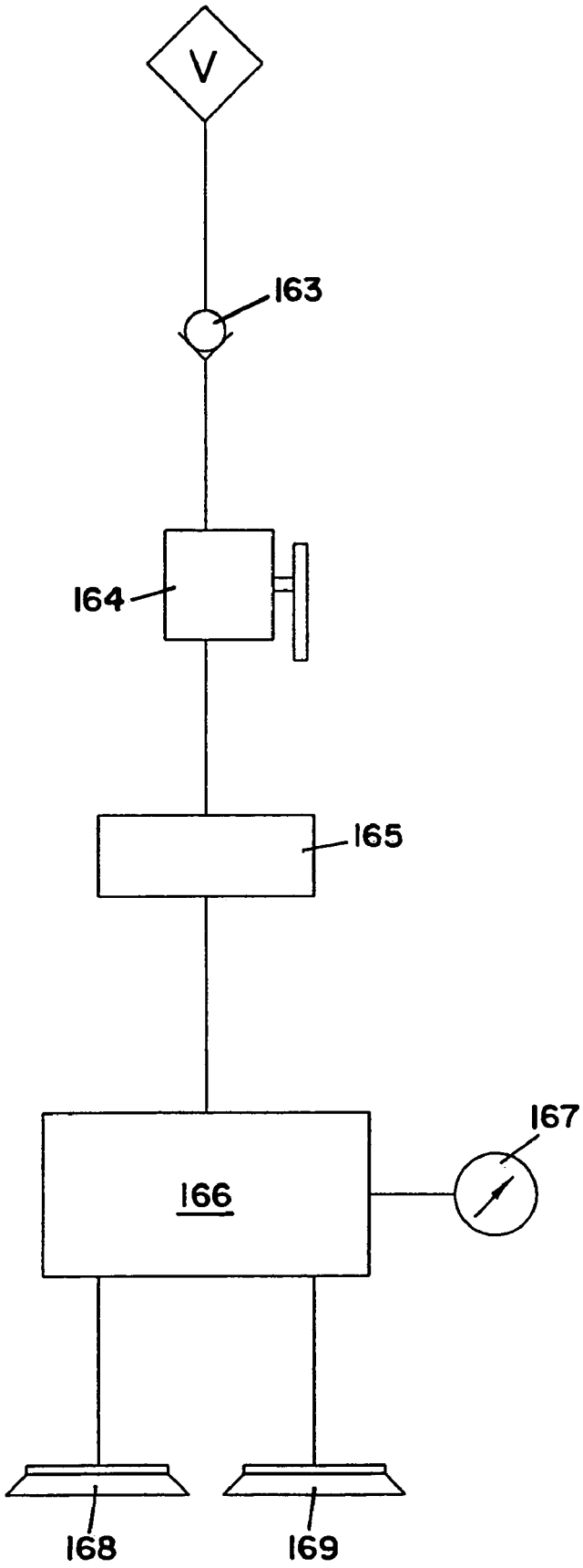
FIG. 16 is a schematic diagram of a pneumatic system of the auxiliary vacuum anchor shown in FIG. 8.

The auxiliary vacuum anchor 160 is much simpler since it relies upon the vacuum anchor 100. FIG. 16 is a schematic diagram of a pneumatic system of the auxiliary vacuum anchor 160. The vacuum V from the vacuum output connector 158 of the vacuum anchor 100 flows through the vacuum hose 162 and enters the auxiliary vacuum anchor 160 via the vacuum input connector 161. A check valve 163 ensures that the vacuum does not exit the auxiliary vacuum anchor 160, and a vacuum control valve 164 controls the vacuum level supplied to the anchor members 168 and 169. The vacuum then flows through a filter 165 and into a manifold 166. The manifold 166 is in fluid communication with a vacuum gauge 167 and the anchor members 168 and 169. The auxiliary vacuum anchor 160 operates similarly to vacuum anchor 100 with fewer components. The vacuum switch 128 also reads both anchor members 168 and 169 since the anchor members 168 and 169 are in fluid communication with the vacuum manifold 125.

Figure 3:
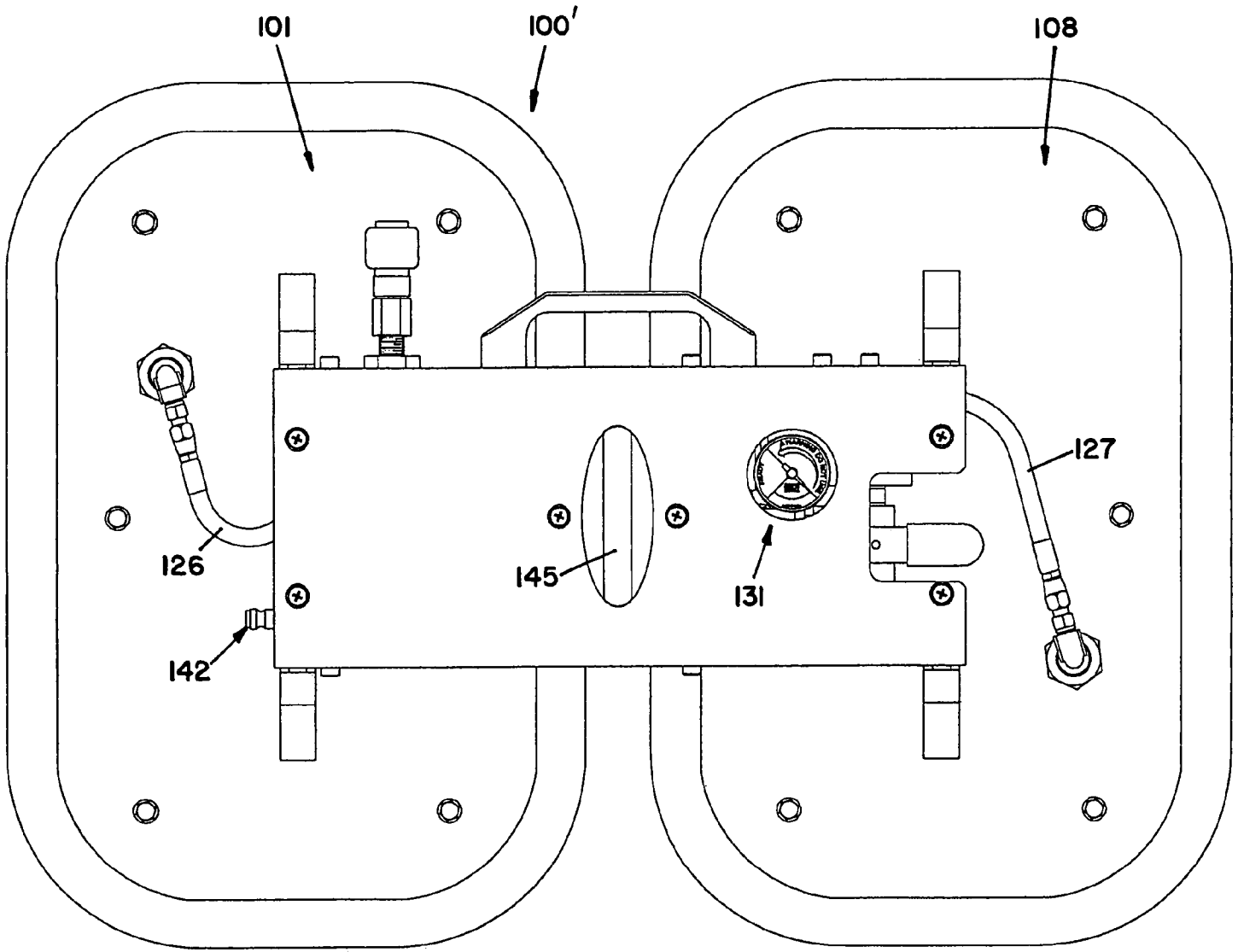
FIG. 3 is a top plan view of the vacuum anchor shown in FIG. 2 with an air compressor bottle and fittings removed.

If it is desired to utilize the vacuum anchor 100 with an external air source rather than using the air cylinder bottle 115, the air hose 141 may be disconnected from the air input connector 142, and an external air source may be connected to the air input connector 142. Alternatively, either an external air source or the air cylinder bottle 115 could be used as a backup air source should the other air source run out or otherwise fail. If the air cylinder bottle 115 and appropriate fittings were removed from the vacuum anchor 100, vacuum anchor 100' shown in FIG. 3 would result and an external air source would be used. The components within the cavity of the vacuum anchor 100' are preferably similar to the components within the cavity of the vacuum anchor 100. The vacuum anchor 100' is not described in detail as it is recognized that vacuum anchors 100 and 100' are similarly constructed. Therefore, vacuum anchors 100 and 100' may be interchangeable.

The vacuum anchor preferably requires an input pressure of 80 to 200 psi and consumes approximately 2.8 cubic feet per minute of compressed air because of the type of pressure regulator used in the preferred embodiment. It is recognized that this may vary depending upon the type of pressure regulator used. The vacuum switch is set to power the alarm if the vacuum level drops below 20 inches Hg. To calculate the capacity of the vacuum anchor, the area (in square inches) of the vacuum seal member(s) is multiplied by the vacuum level (in pounds per square inch). The total area of the vacuum seal members is preferably 360 square inches and the vacuum level of 20 inches Hg converted to psi is 9.82 psi. This results in a capacity of 3,535 pounds. This result applies to loads applied perpendicular to the surface of the anchorage structure. If the load is applied in a direction that would tend to slide the vacuum anchor, this result is reduced slightly, depending on the coefficient of friction between the pad and the surface.

In operation, as shown in FIGS. 6 and 7, air supplied by an air source A flows into the pressure regulator 117. The air source A may be a small, integrally mounted or incorporated 3,000 psi compressed air cylinder bottle, an external compressed air source such as an air compressor or a large compressed air cylinder may be used, or any other suitable air source. The pressure switch 118 opens if the air pressure is greater than approximately 75 psi thereby preventing the alarm 133 from sounding and closes if the air pressure is less than approximately 75 psi thereby causing the alarm 133 to sound. The air then flows through the air valve vacuum switch 120 and into the venturi 122. The venturi 122 receives air and creates a vacuum, which flows through a check valve 121 and into a vacuum manifold 125. Once the vacuum manifold 125 reaches a level of approximately 25 inches Hg, the air valve vacuum switch 120 shuts off so that no compressed air is supplied to the venturi 122, which conserves air. The check valve 121 prevents the vacuum from flowing back into the venturi 122. A vacuum switch 128 opens if the vacuum level is greater than approximately 20 inches Hg thereby preventing the alarm 133 from sounding and closes if the vacuum level is less than approximately 20 inches Hg thereby causing the alarm 133 to sound. From the vacuum manifold 125, the vacuum flows through the filter 130 and the check valve 123, which prevents the vacuum from flowing back into the vacuum manifold 125. The vacuum then flows through the main ball valve for the vacuum control 129 and through the manifold 124. The vacuum gauge 131 indicates the vacuum level. The vacuum is then supplied to the anchor members 101 and 108. The filters 104, 111, and 130 prevent contaminants from entering the anchor members 101 and 108 and the vacuum anchor 100. In addition, if desired, the vacuum anchor 100 may be used to supply vacuum to the auxiliary vacuum anchor 160 via the vacuum output connector 158. The momentary push button 139 may be pressed, which opens the circuit to momentarily silence the alarm 133 while the vacuum anchor 100 is initially being connected.

The vacuum anchors 100, 100', and 160 are preferably used for anchoring to an anchorage structure such as an aircraft, a storage tank, a ship, a submarine, a railcar, a truck, a roof, or other suitable anchorage structure. If used on aircraft, the surface to which the vacuum anchors 100, 100', and 160 may be operatively connected to the fuselage, the wings, and the tail of aircraft without causing any damage to the aircraft. The vacuum anchors 100, 100', and 160 should be operatively connected to the fuselage where supported by frames and stringers and on the upper surface of the wing between the spars. The vacuum anchors 100, 100', and 160 are easily portable and reusable.

Unlike the prior art devices, the vacuum is created internally rather than externally and the vacuum level is monitored within the vacuum anchor rather than at a remote location. All of the components required for generating, monitoring, and maintaining the vacuum level are contained within the self-contained vacuum anchor. Prior art devices require a separate device that generates the vacuum, and the vacuum is then carried to the anchor pad via a hose.

To install the vacuum anchor(s), determine the location(s) of the vacuum anchor(s) and evaluate the strength of the anchorage structure. The anchorage structure must be capable of supporting the loads imposed by the vacuum anchor(s) should a fall occur. If used with a horizontal lifeline system, determine the span length and evaluate the required clearance. If an external air source is being used, the external air source should be located away from traffic and other hazards, and the air hose should be routed away from traffic and other hazards. The surface to which the vacuum anchor is to be attached should be cleaned to absorb excess moisture and remove loose debris, which could reduce the attachment to the anchorage structure and could be pulled into the vacuum anchor and corrode or damage the components.

To attach the vacuum anchor, position the vacuum control valve on the vacuum anchor in the "release pads" position. Place the vacuum anchor in the desired location on the desired anchorage structure and turn the vacuum control valve to the "attach pads" position. The audio alarm will sound thus indicating that the vacuum and resulting suction is not yet sufficient. The momentary push button may be pressed to temporarily silence the low vacuum level alarm during the initial attachment of the vacuum anchor to the anchorage structure. A slight downward pressure on the vacuum anchor members may be required to create an initial seal. If an audio alarm sounds during use, other than initially, an insufficient vacuum level or air pressure may be present and the vacuum anchor may not support the load should a fall occur.

The seal members 103 and 110 make a gas tight seal with the surface of the anchorage structure and the pressure between the surface and the seal members 103 and 110 becomes reduced thereby causing the anchor members 101 and 108 to be held against the surface by virtue of the atmospheric pressure acting on the anchor members 101 and 108. When the anchor members 101 and 108 are secured to the surface, the force required to pull the anchor members 101 and 108 away from the surface is approximately 3,535 pounds as previously calculated. The maximum shear load the anchor members 101 and 108 can withstand before becoming disconnected is dictated largely by coefficient of friction between the seal members 103 and 110 and the surface. To reposition or release the vacuum anchor, the vacuum control valve should be turned to the "release pads" position. When the vacuum anchor has been repositioned, the vacuum control valve is turned to the "attach pads" position as previously stated.

The vacuum anchor 100 may be used by itself as an anchorage point secured to an anchorage structure 178 as shown in FIG. 9. An energy absorbing lanyard 181 or other suitable device is used to interconnect a harness 180 donned by a user and the connector of the vacuum anchor 100. Alternatively, more than one vacuum anchor 100 may be used or the vacuum anchor 100 may be operatively connected to the auxiliary vacuum anchor 160 secured to the anchorage structure 178 for use with a horizontal lifeline system as shown in FIG. 10. If the auxiliary vacuum anchor 160 is used, it is connected to the vacuum anchor 100 via hose 162. One end of a cable 185 is operatively connected to the vacuum anchor 100 with an energy absorber 183 and a cable tensioner 184, and the other end of the cable 185 is operatively connected to the auxiliary vacuum anchor 160 with an energy absorber 183. The cable 185 is preferably a synthetic lifeline, but it is recognized that any suitable material such as a rope or a metal cable may be used. An energy absorbing lanyard 181 or other suitable device is used to interconnect a harness 180 donned by a user and the cable 185.

If two or more vacuum anchors are used for securing a horizontal lifeline, both vacuum anchors should be installed at approximately the same elevation so the horizontal lifeline system is not sloped more than five degrees. The cable tensioners are loosened and repositioned as required. The slack is removed from the cable and the cable is tensioned as is well known in the art. A connecting subsystem such as an energy absorbing lanyard is used to interconnect a safety harness donned by the user and the cable of the horizontal lifeline system. The vacuum anchor(s) should be positioned near the work location to minimize swing fall hazards, and the connecting subsystem length should be kept as short as possible to reduce the potential free fall and required clearance distance.

Levels of pressure and vacuum for use with the preferred components are listed for illustrative purposes only as it is recognized that the levels of pressure and vacuum may vary depending upon the components used. Therefore, the present invention is not limited to the levels of pressure and vacuum listed herein. The above specification, examples and data provide a complete description of the manufacture and use of the composition of the invention. Since many embodiments of the invention can be made without departing from the spirit and scope of the invention, the invention resides in the claims hereinafter appended.

I claim:

1. A vacuum anchor assembly for anchoring a fall protection system to a surface of an anchorage structure, comprising:

a) an anchor member having an air input connector, a venturi, and a seal member incorporated into the anchor member;

b) the air input connector configured and arranged to receive air from a pressurized air source;

c) the venturi in fluid communication with the air input connector configured and arranged to receive air and create a vacuum therefrom;

d) the seal member in fluid communication with the venturi configured and arranged to receive the vacuum and resulting suction and create a seal between the anchor member and the surface of the anchorage structure sufficient to operatively connect the anchor member to the surface of the anchorage structure with the vacuum and resulting suction created within the anchor member; and e) a check valve and a control valve incorporated into the anchor member between the venturi and the seal member to control the vacuum supplied to the seal member and allow for the anchor member to be released from the surface of the anchorage structure.

2. The vacuum anchor assembly of claim 1, wherein the pressurized air source is a compressed air cylinder.

3. The vacuum anchor assembly of claim 2, wherein the compressed air cylinder is a bottle containing 3,000 psi compressed air operatively connected to the anchor member.

4. The vacuum anchor assembly of claim 1, the anchor member further comprising a vacuum outlet connector configured and arranged to supply vacuum created within the anchor member to an auxiliary anchor member.

5. The vacuum anchor assembly of claim 1, the anchor member further comprising a vacuum switch operatively connected to an indicator, the vacuum switch opening if the vacuum level is greater than a predetermined vacuum level thereby preventing the indicator from providing an indication of low vacuum level and closing if the vacuum level is less than the predetermined vacuum level thereby causing the indicator to provide an indication of low vacuum level.

6. The vacuum anchor assembly of claim 5, wherein the predetermined vacuum level is approximately 20 inches Hg.

7. The vacuum anchor assembly of claim 1, the anchor member further comprising a pressure switch operatively connected to an indicator, the pressure switch opening if the air pressure is greater than a predetermined air pressure thereby preventing the indicator from providing an indication of low air pressure and closing if the air pressure is less than the predetermined air pressure thereby causing the indicator to provide an indication of low air pressure.

8. The vacuum anchor assembly of claim 7, wherein the predetermined air pressure is approximately 75 psi.

9. A self-contained vacuum anchor assembly for anchoring a fall protection system to a surface of an anchorage structure, comprising:

a) an anchor member having a housing, an air input connector, a venturi, and a seal member incorporated into the anchor member, the housing containing the venturi;

b) the air input connector configured and arranged to receive air from a pressurized air source;

c) the venturi in fluid communication with the air input connector configured and arranged to receive air and create a vacuum therefrom;

d) the seal member in fluid communication with the venturi configured and arranged to receive the vacuum and resulting suction and create a seal between the anchor member and the surface of the anchorage structure sufficient to operatively connect the anchor member to the surface of the anchorage structure with the vacuum and resulting suction created within the anchor member; and e) a check valve and a control valve incorporated into the anchor member between the venturi and the seal member to control the vacuum supplied to the seal member and allow for the anchor member to be released from the surface of the anchorage structure.

10. The self-contained vacuum anchor assembly of claim 9, wherein the pressurized air source is a bottle containing 3,000 psi compressed air operatively connected to the anchor member.

11. The self-contained vacuum anchor assembly of claim 9, the anchor member further comprising a vacuum outlet connector configured and arranged to supply vacuum created within the anchor member to an auxiliary anchor member.

12. The self-contained vacuum anchor assembly of claim 9, the anchor member further comprising a vacuum switch operatively connected to an indicator, the vacuum switch opening if the vacuum level is greater than a predetermined vacuum level thereby preventing the indicator from providing an indication of low vacuum level and closing if the vacuum level is less than the predetermined vacuum level thereby causing the indicator to provide an indication of low vacuum level.

13. The self-contained vacuum anchor assembly of claim 12, wherein the predetermined vacuum level is approximately 20 inches Hg.

14. The self-contained vacuum anchor assembly of claim 9, the anchor member further comprising a pressure switch operatively connected to an indicator, the pressure switch opening if the air pressure is greater than a predetermined air pressure thereby preventing the indicator from providing an indication of low air pressure and closing if the air pressure is less than the predetermined air pressure thereby causing the indicator to provide an indication of low air pressure.

15. The self-contained vacuum anchor assembly of claim 14, wherein the predetermined air pressure is approximately 75 psi.

16. A method of securing a vacuum anchor assembly to a surface of an anchorage structure for anchoring a fall protection system to the surface, comprising:

a) placing the vacuum anchor assembly on the surface of the anchorage structure;

b) connecting the vacuum anchor assembly to a pressurized air source;

c) creating a vacuum internally within the vacuum anchor assembly from the pressurized air source;

d) securing the vacuum anchor assembly to the surface of the anchorage structure with suction resulting from the vacuum; and e) opening a control valve between a venturi and a seal member to release the vacuum from the vacuum anchor assembly to allow the vacuum anchor assembly to be released from the surface of the anchorage structure.

17. The method of claim 16, further comprising connecting the vacuum anchor assembly to a bottle containing 3,000 psi compressed air operatively connected to the anchor member, the bottle being incorporated into the vacuum anchor assembly.

18. The method of claim 16, further comprising supplying the vacuum from the vacuum anchor assembly to an auxiliary vacuum anchor assembly and securing the auxiliary vacuum anchor assembly to the surface of the anchorage structure with suction resulting from the vacuum supplied by the vacuum anchor assembly.

* * * * *